US005927846A

United States Patent [19]

Sinclair

[11] Patent Number: 5,927,846

[45] Date of Patent: Jul. 27, 1999

[54] DISPOSABLE PLANAR FLASHLIGHT

[76] Inventor: Iain Sinclair, P.O. Box 807, Hildersham, Cambridge CB1 6BX, United Kingdom

[21] Appl. No.: 08/369,719

[22] Filed: Jan. 6, 1995

[51] Int. Cl.[6] ..... F21L 7/00

[52] U.S. Cl. ..... 362/189; 362/200; 362/201

[58] Field of Search ..... 362/189, 200, 362/201, 205

[56] References Cited

U.S. PATENT DOCUMENTS

| | | | |
|---|---|---|---|
| D. 367,720 | 3/1996 | Sinclair . | |
| 2,625,645 | 1/1953 | Crane . | |
| 2,699,192 | 1/1955 | Poutinen . | |
| 2,879,381 | 3/1959 | Coffey | 362/189 |
| 3,243,586 | 3/1966 | Fioravanti . | |
| 3,296,429 | 1/1967 | Schwartz . | |
| 3,310,668 | 3/1967 | Schwartz . | |
| 3,377,475 | 4/1968 | Frigon . | |
| 3,796,869 | 3/1974 | Stone | 362/189 |
| 4,085,315 | 4/1978 | Wolter et al. . | |
| 4,122,510 | 10/1978 | Halliday, Jr. . | |
| 4,237,527 | 12/1980 | Breedlove | 362/189 |
| 4,242,724 | 12/1980 | Stone . | |
| 4,250,539 | 2/1981 | Leitzel et al. . | |
| 4,368,507 | 1/1983 | Reynolds . | |
| 4,392,186 | 7/1983 | Cziment . | |
| 4,521,833 | 6/1985 | Wolter . | |
| 4,628,418 | 12/1986 | Chabria . | |
| 4,819,140 | 4/1989 | Griffin . | |
| 4,926,300 | 5/1990 | Ralston . | |
| 5,463,539 | 10/1995 | Vandenbelt et al. | 362/189 |

*Primary Examiner*—Thomas M. Sember
*Attorney, Agent, or Firm*—Price Gess & Ubell

[57] ABSTRACT

A thin, disposable, extremely bright flashlight is constructed around a thin, planar dry cell battery. The battery, a switch, and miniature incandescent lamps are sealed within a flexible cover of approximately the size of a playing card. The sealed construction removes any danger from electrical sparks in a flammable atmosphere. A window of translucent or transparent material is provided at one end of the package. Two miniature lamps, which may be overdriven to increase their brightness, are located behind this window. The lamps are sufficiently bright that a beam collimation system is unnecessary. Squeezing the package at a designated location closes a dome switch, causing the lamps to light. Releasing pressure on the dome switch opens the circuit so that the light cannot be inadvertently left on.

15 Claims, 2 Drawing Sheets

DISPOSABLE PLANAR FLASHLIGHT

BACKGROUND OF THE INVENTION

1. Field of the Invention

The current invention concerns the art of portable light sources and, more specifically, a thin, planar, bright disposable flashlight.

2. Description of Related Art

The history of the flashlight goes back almost to the invention of the electric incandescent lamp. The electric lamp made possible a portable light source that was immune to wind currents that would extinguish a candle and was compact and cool to the touch, unlike oil or carbide lanterns.

A typical prior art flashlight 10 is shown in FIG. 1. The unit comprises a cylindrical body 12 for containing dry cell batteries 11. The batteries 11 are normally arranged in a series configuration because the 1.5 volts provided by a typical battery is generally inadequate to produce a sufficiently bright light. A lamp 13 is in contact with one terminal of the battery 11, while a switch 14 regulates operation of the lamp 13 by completing an electrical circuit between a second battery terminal and the lamp 13. To increase the effective brightness of the flashlight 10 by focusing the output light in a small beam, the lamp 13 is surrounded by a reflector 15 which is protected by a clear lens 16.

The typical flashlight is ideal for emergency use since it can be conveniently stored in a cupboard or a drawer and, thus, be available to provide light when normal electric power fails as during a storm or earthquake. Of course, if the flashlight is sufficiently small and inexpensive, units can be left at a number of locations where a portable light is occasionally of great use (i.e., in the glove compartment of an automobile, by an electric fuse panel in a basement, inside a garage cupboard or similar unlighted storage area).

However, flashlights are frequently bulky, particularly if several dry cell batteries are included in a series arrangement (usually end to end) to provide power for an especially bright lamp. The sheer bulk and length of multiple battery flashlights tends to make it difficult to stow a bright flashlight in a coat pocket or other convenient location. Miniature flashlights which contain only one or two miniature dry cell batteries have been produced, but they are typically less bright than a full size flashlight and also tend to have a fairly brief period of operation before the light dims and the dry cells must be replaced.

There have been a number of bright miniature flashlights produced through the use of special light bulb technologies such as krypton or halogen lamps manufactured to center the lamp's filament, thereby facilitating the focusing of the flashlight's beam. However, such miniature flashlights are often expensive, both because of the special lamps, and because of the machining costs of the miniature flashlight body. Their high cost tends to mitigate against the deployment of numerous flashlights for emergency use.

Another problem with traditional flashlights, particularly when they are stowed in numerous locations for possible emergency use, is that the dry cell batteries lose power with age and/or leak, damaging the expensive flashlight body. Therefore, if a number of conventional flashlights are to be deployed for future emergency use, it is necessary to check them fairly frequently and replace the dry cell batteries before any damage from leaking batteries occurs.

There have also been some efforts to deal with the bulk of flashlights by arranging the batteries in a side-by-side configuration. This produces a flashlight of an overall rectangular configuration. Such a unit is more likely to fit into a purse or pocket, but the thickness of ordinary dry cell batteries requires that the rectangular flashlight be relatively bulky. For example, rectangular flashlights designed to operate on side-by-side AA batteries are generally almost an inch thick.

OBJECTS AND SUMMARY OF THE INVENTION

It is an object of the present invention to provide an inexpensive flashlight that can be readily located in appropriate locations for emergency use;

It is also an object of the present invention to provide an inexpensive flashlight that can be extremely bright;

It is a further object of the present invention to provide an inexpensive flashlight that is very thin to facilitate stowing;

It is another object of the present invention to provide an inexpensive, bright flashlight that comprises a sealed disposable unit; and It is yet another object of the present invention to provide a thin, inexpensive disposable flashlight with a card-like profile so that a large planar area is provided for advertisements or similar printed matter.

These and additional objects are provided by a thin, disposable flashlight constructed around a thin, planar dry cell battery. The battery, a switch, and miniature incandescent lamps are sealed within a flexible cover of approximately the size of a playing card. The sealed construction avoids any danger from electrical sparks in flammable atmospheres. A window of translucent or transparent material is provided at one end of the package. Two miniature lamps, which may be overdriven to increase their brightness, are located behind this window. The lamps are sufficiently bright that a beam collimation system is unnecessary. Squeezing the package at a designated location closes a dome switch, causing the lamps to light. Releasing pressure on the dome switch opens the circuit so that the light cannot be inadvertently left on.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a bright, inexpensive flashlight which has a very thin, card-like aspect and is disposable.

Figure 1:
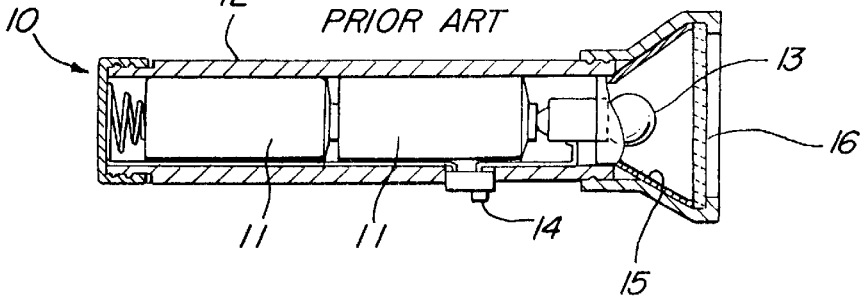
FIG. 1 PRIOR ART
FIG. 1 shows a typical prior art flashlight of a generally cylindrical form.

Much of the structure of the prior art flashlight 10 shown in FIG. 1 is required for making both the lamp 13 and the batteries 11 replaceable and not for producing a usable light. If the lamp, batteries, and switch could be provided as a sealed unit, a disposable flashlight would result. However, the need for a reflector and lens system to collimate the flashlight beam adds considerably to the complexity and cost of the device, making disposability less feasible.

However, when a sufficiently bright lamp is employed, a useable flashlight can be produced without the complexity of a reflector system. Actually, such a flashlight is more useful than conventional collimated beam lights for peering into a dark closet, locating an electrical panel in the dark, or indicating the presence of a pedestrian on the side of a darkened highway.

Figure 2:
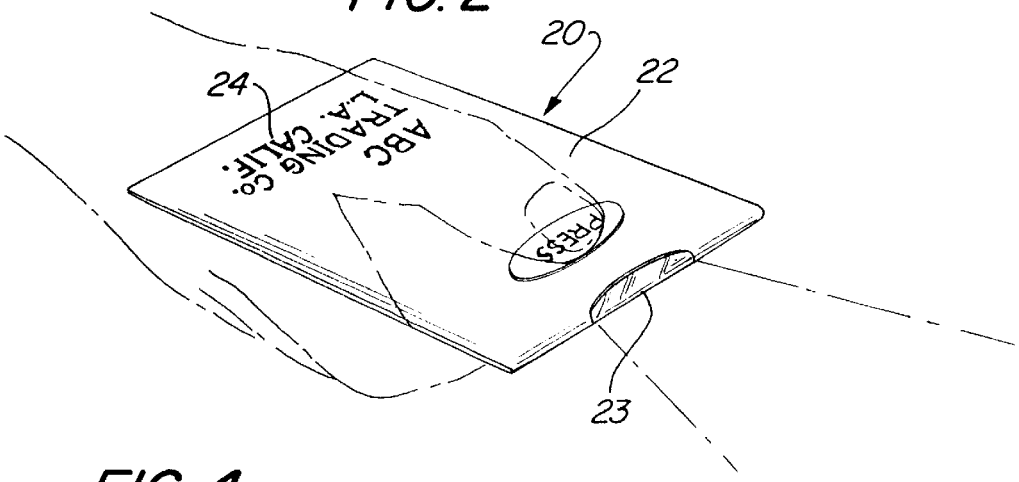
FIG. 2 shows a perspective view of a flashlight of the present invention.
Figure 4:
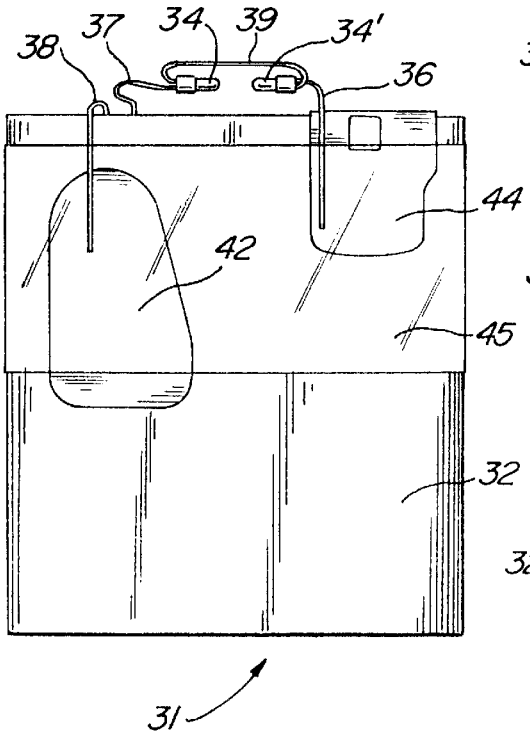
FIG. 4 shows a rear view of the inner assembly of FIG. 3.
Figure 3:
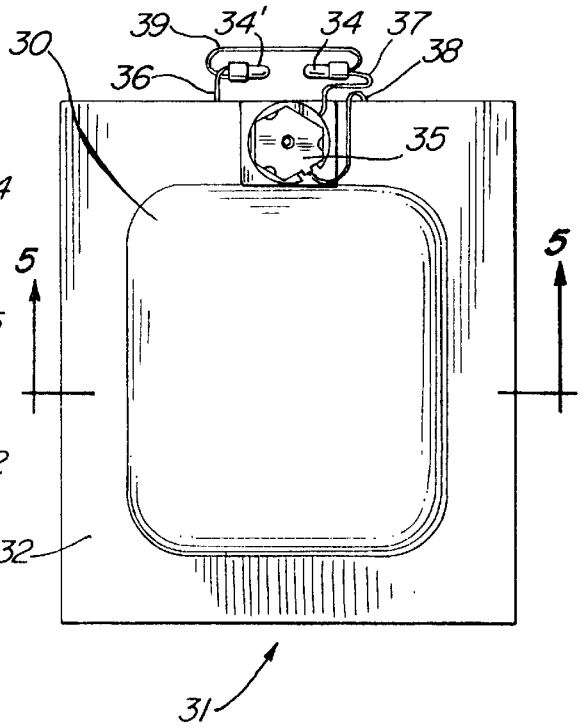
FIG. 3 shows an inner battery assembly of the flashlight of FIG. 2 with the switch showing.

The present invention 20, as shown in FIGS. 2, 3, and 4, comprises a novel disposable flashlight constructed around a special thin, flat dry cell battery 32 such as the type used to supply power for certain cameras and like applications. Currently, a POLAPULSE P80 thin-pack battery produced by the Polaroid Corporation of Cambridge, Mass. is preferred. This battery, which has a shelf life of at least three years, produces about six volts and is about 3¼ inches long by 2½ inches wide and about ⅛-inch thick. The front face of the battery 32, shown in FIG. 3, bears a raised power bulge 30 which accounts for most of the thickness of the battery 32; edge portions around the power bulge 30 are much thinner. The rear face (FIG. 4) of the battery 32 bears two large, flat conductive terminals 42 and 44. This battery with the lamps employed allows the flashlight to operate for at least 30 minutes. Battery life is shortest with continuous use; with intermittent use the battery 32 regenerates and gives a considerably longer life. Other thin, dry cell batteries are equally usable in the present invention as long as their dimensions allow for convenient carrying in a shirt pocket or storage in a small drawer or other tight location, and the lifetimes of the batteries are sufficient.

In keeping with the goals of producing an inexpensive, disposable flashlight, the flat battery 32 and attached lamps and switch, which comprise battery assembly 31, are enclosed by a tight-fitting, flexible, yet resilient cover 22. The cover 22 should be sufficiently flexible to allow operation of the flashlight, but should be sufficiently rigid or resilient to smooth over irregularities such as the power bulge 30.

The cover 22 not only protects the battery assembly 31, but also provides a suitable surface for the printing of various graphics and messages 24. A cardboard-type material is preferred for the cover 22 because it has the right balance of flexibility and resiliency and because it allows full color lithographic printing. Many other usable cover materials such as plastics often require screen printing which tends to be more expensive and produce lower resolution images. An inexpensive flashlight such as that of the present invention is an ideal vehicle for advertisements. The units can be given away as favors or sold at a low price which is subsidized through the sale of advertising space.

Figure 5:
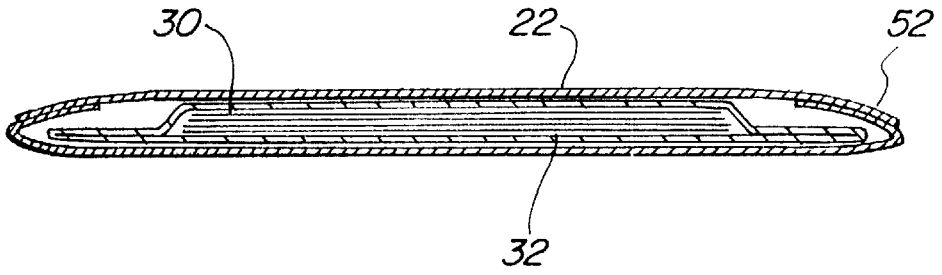
FIG. 5 is a cross-section of the flashlight of FIG. 2.
Figure 6:
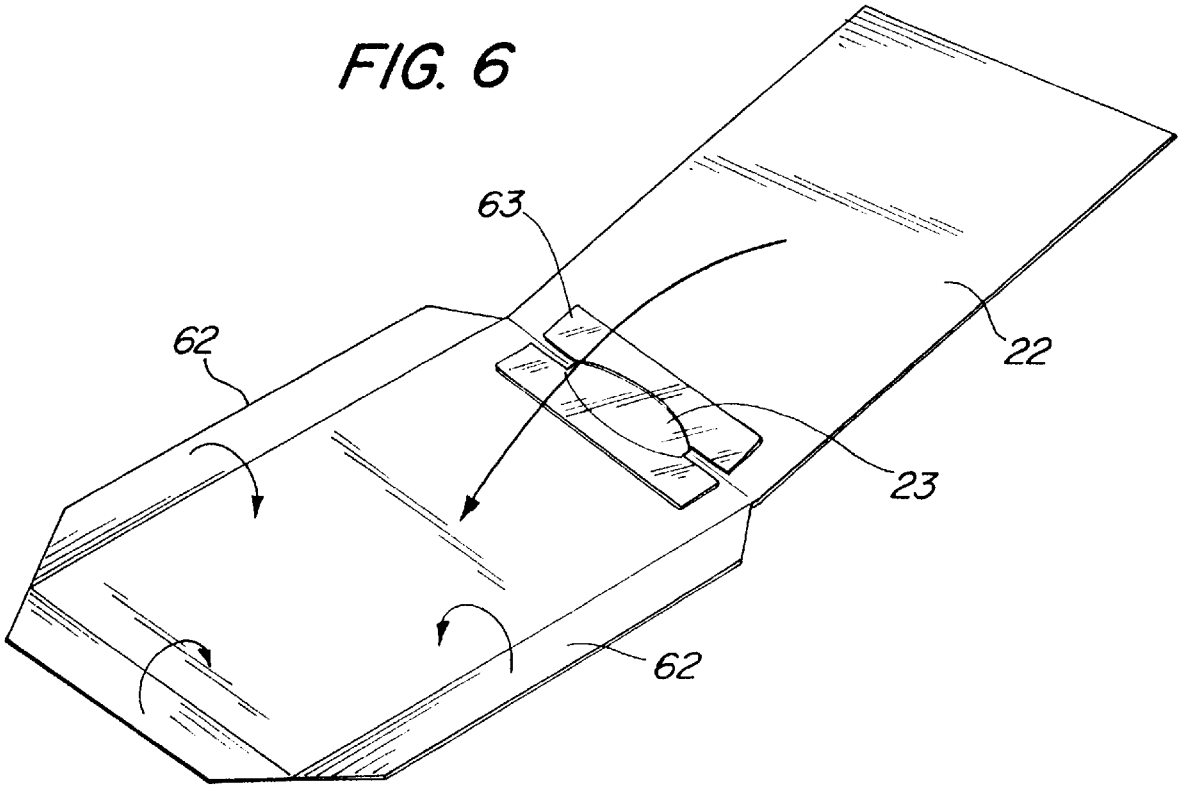
FIG. 6 shows a cover of the flashlight of FIG. 2 before assembly of the flashlight.

The flexible cover 22 can be conveniently cut from a suitable material such as thin cardboard or plastic. Cardboard covers can then be rendered waterproof by laminating a thin plastic film over the cover following lithographic printing. As shown in FIG. 6, the cut material can then be folded to enclose the battery assembly 31. Tabs 62 at three of the edges are folded over to retain the battery assembly 31 and to provide a surface for application of adhesive. FIG. 5 shows a cross-section through the flashlight 20, revealing that the cover 22 is designed to be thinner at edges 52, thereby accentuating the apparent thinness of the completed device 20. Note that the resiliency of the cardboard cover causes the material to form a smooth arc over the power bulge 30. The tabs 62 help in the smoothing process by partially filling in around the power bulge 30. Generally, the most satisfactory cover 22 is cut from a flexible, yet resilient, sheet of cardboard or similar material.

Alternatively, the flexible cover 22 can be extruded in a flattened tube-like form from a suitable plastic material. The tube can then be cut into lengths, the battery assembly 31 inserted, and the open ends sealed with heat or adhesive. Or a frame of a stiff material can be constructed to surround the battery 32 and covered by resilient sheet material.

The flexible cover 22 shown in FIG. 6 has been cut from a sheet of opaque cardboard material. An oval window 23 is cut through the flexible cover 22 to allow passage of the flashlight beam. The window 23 is advantageously covered by a piece 63 of transparent or translucent material to protect the lamps 34. Heavy parchment-like tracing paper is ideal, since it can be cut and folded readily and easily glued or attached with tape to the flexible cover 22 before folding the translucent piece 63 and the cover 22 around the battery assembly 31.

Any number of other translucent and/or transparent plastic materials such as cellulose acetate, polyethylene, or mylar can be used to cover the window 23. Likewise, the exact shape of the window 23 may be oval, circular, rectangular, trapezoidal, or any other appropriate shape.

It is also possible to make the entire flexible cover 22 from a transparent or translucent material with regions other than the window 22 printed with an opaque ink, thus forming a base to receive printed advertisements or graphics.

The present invention uses miniature incandescent lamps of the configuration sometimes referred to as "grain of wheat" lamps. More exotic lamps such as krypton bulbs or halogen lamps could also be employed, although such lamp types tend to be rather expensive for use in a disposable device that has a relatively short operative life. The relatively short life of the disposable flashlight allows the lamps to be operated more brightly than would be possible in a standard flashlight where the bulbs must last for at least several hours. For example, miniature lamps rated at 500 ma at 2.5 volts are used in a 6-volt circuit. Thus, the lamps are "overdriven," delivering a wattage of between 1.5 to 3 times their normally rated wattage.

Although a single lamp can be employed, it has been found that the use of two connected lamps is the most expeditious way to produce a very bright flashlight. When a single lamp of adequate wattage is used, the lamp may become excessively hot during extended operation. By using two lamps of a lesser wattage, the heat problem is reduced to acceptable levels. Similarly, three or more lamps can be advantageously used in some situations; however, the two lamp arrangement is both economical and effective.

The cover 22 is made from flexible material so that it snugly accommodates the battery assembly 31 and so that a pressure sensitive switch 35 can easily be operated by pressure applied through the cover 22. Finger pressure applied to the switch (note "PRESS" marking in FIG. 2) causes the lamp to light. The lamp remains lit only as long as the pressure continues. Thus, the flashlight cannot be accidentally left on. The switch 35 is mounted on the front face of the battery 32 above the power bulge 30. This arrangement ensures against accidental operation. If pressure is applied over the entire front surface of the flashlight 20, the power bulge 30 will prevent the switch 35 from being activated.

The preferred switch type is a dome switch somewhat similar to those found so ubiquitously in calculator keypads, but the switch is of heavy duty construction to withstand the current of a flashlight circuit. The dome switch 35 is comprised of a domed metal contact which temporarily buckles under pressure to contact a flat metal contact thus closing the circuit. The dome serves both as contact and return "spring." Although other types of pressure sensitive switches can be employed, the dome switch 35 provides the ideal combination of economy and ruggedness. A significant advantage of this configuration is that electric components are completely sealed within the flexible cover 22. Thus, there is no danger of a spark from the unit igniting flammable gases, so that the present invention can be safely used in virtually any environment.

In the preferred circuit the dome switch 35 is attached to the front face of the battery 32 using a suitable adhesive or double-sided tape (FIG. 3). A first lead 38 connects the dome switch 35 to a first battery terminal 42 located on the rear face of the battery as shown in FIG. 4. The dome switch 35 is also connected to a first incandescent lamp 34 by a second lead 37. The first lamp 34 is connected in a series circuit to a second incandescent lamp 34' by lead 39. The second lamp 34' is, in turn, connected by a lead 36 to a second battery terminal 44 located on the rear face of the battery 32. As shown in FIG. 4, the connection of leads 36, 38 to terminals 44, 42, respectively, can be made holding them in place with a piece 45 of tape. Alternatively, the leads can be crimped to a contact clip or soldered directly to the battery 32.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A miniature planar flashlight comprising:

a battery assembly comprising:

a planar dry cell battery;

a dome switch; and two miniature electric lamps connected in series, overdriven to operate at more than 1.5 times their rated wattage, and operationally connected with the dome switch and the dry cell battery so that applied pressure causes the dome switch to close, energizing the lamps; and a flexible cover allowing pressure to be applied to the switch, accepting printed indicia, and having a window at one end, the window covered with a translucent material, said cover cut from a sheet of flexible, yet resilient material, folded over the battery assembly and sealed at first, second and third edges with the translucent material, folded, and disposed over the lamps.

2. A compact planar flashlight comprising:

a planar battery having a thickness of approximately one eighth of an inch;

a lamp assembly operably connected to said planar battery, including a pressure sensitive switch for electrically connecting and disconnecting said lamp assembly to said planar battery; and a resilient cover formed from a folded sheet and enclosing said lamp assembly and said planar battery, said folded sheet further comprising a window disposed on said folded sheet such that said lamp assembly is positioned adjacent said window when said resilient cover is folded over said planar battery and lamp assembly.

3. The compact planar flashlight of claim 2 wherein said window is positioned at the center of said sheet such that said sheet, when folded in half, positioned the window at an edge of said resilient cover.

4. The compact planar flashlight of claim 2 wherein said window is translucent.

5. The compact planar flashlight of claim 2 wherein the resilient cover comprises a cardboard sheet with a hole, and a translucent material placed over said hole at said lamp assembly, said translucent material serving as said window.

6. The compact planar flashlight of claim 2 wherein said resilient cover further comprises graphics on an outer surface thereof.

7. The compact planar flashlight of claim 2 wherein said planar battery is approximately two and one-half inches wide by three and one quarter inches long.

8. The compact planar flashlight of claim 2 wherein said pressure sensitive switch is disposed beneath said resilient cover when said resilient cover encloses said lamp assembly, and where graphics on said flexible cover indicate a location of the pressure sensitive switch.

9. The compact planar flashlight of claim 2 wherein the lamp assembly is overdriven to at least one and one-half times its nominal voltage.

10. A lightweight disposable flashlight comprising:

a flat battery of generally rectangular dimensions;

a lamp operably connected to said flat battery, said battery having a voltage at least one and one-half times a rated voltage of said lamp;

a switch electrically connecting and disconnecting said lamp from said flat battery; and a flexible cover enclosing said light generating unit, said flexible cover folded from a sheet and formed into a flat pocket for receiving said light generating unit, said flexible cover having first and second surfaces each having separate first, second, and third edges, a mutual fourth edge defined by a fold in said sheet.

11. A miniature planar flashlight comprising:

a flexible cover means for accepting printed indicia and with a window of translucent material for transmitting light; and a battery assembly sealed within the flexible cover, the battery assembly comprising:

a planar dry cell battery;

a pressure sensitive switch; and a first miniature electric lamp disposed beneath the window and operationally connected with the pressure sensitive switch and the dry cell battery so that pressure exerted through the flexible cover will cause the pressure sensitive switch to close, energizing the first miniature electric lamp, the first miniature electric lamp further over driven to operate at more than 1.5 times its rated wattage.

12. The miniature planar flashlight of claim 11 further comprising a second miniature electric lamp connected in series with the first miniature electric lamp.

13. The miniature planar flashlight of claim 12 wherein said second miniature electric lamp is over driven to operate at more than 1.5 times its rated wattage.

14. A miniature planar flashlight comprising:

a battery assembly comprising:

a planar dry cell battery;

a pressure sensitive dome switch; and light source means operationally connected with the pressure sensitive switch and the dry cell battery so that applied pressure causes the pressure sensitive switch to close, energizing the lamps, said light source means comprising at least one miniature electric lamp and at least one of said miniature electric lamps are over driven to operate at more than 1.5 times their rated wattage;

and;

a flexible cover means for allowing pressure to be applied to the pressure sensitive switch, for accepting printed indicia and having a translucent window for transmitting light, said cover formed from a sheet of flexible, yet resilient material, and foldingly sealed over the battery assembly with the translucent window disposed over the lamps.

15. A miniature planar flashlight comprising:

a planar dry cell battery;

a pressure sensitive switch;

two miniature electric lamps overdriven to operate at more than 1.5 times their rated wattage, said lamps operationally connected with the pressure sensitive switch and the dry cell battery so that applied pressure causes the pressure sensitive switch to close, energizing the lamps; and a flexible cover means for allowing pressure to be applied to the pressure sensitive switch, for accepting printed indicia, and having a window at one end, the window covered with translucent material, said cover cut from a sheet of flexible, yet resilient material, folded over the battery assembly and edge sealed with the translucent material folded and disposed over the lamps.

* * * * *